US009347306B2

(12) United States Patent
McHugh et al.

(10) Patent No.: US 9,347,306 B2
(45) Date of Patent: May 24, 2016

(54) SYSTEM AND METHOD FOR THE AUTONOMOUS DRILLING OF GROUND HOLES

(71) Applicants: Technological Resources Pty. Limited, Melbourne (AU); University of Sydney, Sndney (AU)

(72) Inventors: Charles McHugh, Kensington (AU); Florian Andreas Oppoizer, Macleod (AU)

(73) Assignees: Technological Resources Pty. Limited, Melbourne (AU); University of Sydney, Sydney (AU)

( * ) Notice: Subject to any disclaimer, the term of this patent is extended or adjusted under 35 U.S.C. 154(b) by 237 days.

(21) Appl. No.: 13/949,715

(22) Filed: Jul. 24, 2013

(65) Prior Publication Data

US 2014/0083767 A1 Mar. 27, 2014

Related U.S. Application Data

(63) Continuation of application No. 12/958,068, filed on Dec. 1, 2010, now abandoned.

(30) Foreign Application Priority Data

Feb. 12, 2009 (AU) ..... 2009905887

(51) Int. Cl.
*E21B 44/02* (2006.01)
*E21B 44/00* (2006.01)

(52) U.S. Cl.
CPC ..... *E21B 44/02* (2013.01); *E21B 44/00* (2013.01)

(58) Field of Classification Search
CPC ..... E21B 44/02; E21B 44/00; E21B 21/08; E21B 15/00; E21B 15/04
See application file for complete search history.

(56) References Cited

U.S. PATENT DOCUMENTS

| | | | | |
|---|---|---|---|---|
| 3,613,805 | A | 10/1971 | Lindstad et al. | |
| 5,273,122 | A | 12/1993 | Henneuse | |
| 5,844,133 | A | 12/1998 | Goto | |
| 6,637,522 | B2 | 10/2003 | Wilson et al. | |
| 8,261,855 | B2 | 9/2012 | Stacy, II et al. | |
| 2008/0173480 | A1 * | 7/2008 | Annaiyappa et al. | 175/24 |

FOREIGN PATENT DOCUMENTS

WO 20110059912 5/2011

OTHER PUBLICATIONS

Australian Appn No. 2010249159, Examination Report, dated Mar. 10, 2015.

* cited by examiner

*Primary Examiner* — Yong-Suk (Philip) Ro
(74) *Attorney, Agent, or Firm* — Banner & Witcoff, Ltd.

(57) ABSTRACT

A system and method for the drilling of ground holes by a track steer drill rig. The system and method include a drilling arrangement that permits the speed of drilling holes to be balanced against the stability of the hole thus formed. The system and method allow for the autonomous drilling of ground holes and, particularly, although not exclusively, for the purposes of exploration, mining, and/or construction. In particular, the system and method relate to the autonomous drilling of ground holes which are used for subsequent blasting.

36 Claims, 7 Drawing Sheets

SYSTEM AND METHOD FOR THE AUTONOMOUS DRILLING OF GROUND HOLES

TECHNICAL FIELD

This invention relates to a method for the autonomous drilling of ground holes and, particularly, although not exclusively, to the autonomous drilling of ground holes for the purposes of exploration, mining and/or construction. In particular, the invention relates to the autonomous drilling of ground holes which are used for subsequent blasting.

BACKGROUND

Typically, ground holes are drilled by drill rigs in order to produce a hole for use in mining or construction. In some instances, these holes are drilled by a drill rig controlled by a user who plans and executes the drilling process.

The operation of a drill rig requires the consideration of many variables before the user can successfully initiate and complete the drilling operation. These variables include ground or surface conditions, the geological status of the area, environmental conditions, the intended purpose of the hole and the inherent limitations of the drilling equipment. In some situations, there may not be enough information at the initial stage for the user to make an appropriate or informed decision in other words once drilling has commenced, the user generally makes appropriate adjustments in order to successfully drill the hole.

In situations such as mining or construction, it may be necessary to drill many holes in a large geographic area. Typically, where the user is required to make appropriate adjustments in order to successfully drill a hole, the drilling process may be inefficient, expensive and time consuming.

In open mining operations, for example, there is a need to balance the speed of drilling holes against the stability of the hole formed. When preparing the ground for blasting there may be literally hundreds of holes required with drilling, which may take a number of days to drill. There may also be some time before the holes are eventually filled with explosives for blasting. In the event of materials re-entering the holes, the effectiveness of the subsequent blast is reduced.

Where significant hole re-filling occurs there can be a need to re-drill such holes. In all ground filling, it is usual for a collar of drilled material to form around the drill string creating the hole. The stability of such a collar is dependent on many factors—geology, waste chip size, etc. In open pit mining an additional factor is that the surface being drilled may be disturbed or broken, such as from earlier blasting and the subsequent removal of blast material. Thus, it is critical that a stable collar is formed so that backfilling of the hole during drilling for post drilling is minimized or avoided.

SUMMARY OF THE INVENTION

In accordance with a first aspect of the present invention, there is provided a method for the autonomous drilling of ground holes by a drill rig including a drilling arrangement, comprising the step of: utilising an autonomous drilling procedure to control the drilling arrangement to drill the hole upon locating the drill rig in a position where the hole is to be drilled.

In an embodiment of the first aspect, the drilling procedure comprises the step of instructing the drilling arrangement to drill in a manner which produces a collar around the hole with debris from the hole.

In an embodiment of the first aspect, the drilling procedure further comprises the step of instructing the drilling arrangement to flush the drill hole.

In an embodiment of the first aspect, the drilling procedure further comprises the step of instructing the drilling arrangement to stabilise the inner walls of the hole.

In an embodiment of the first aspect, the drilling procedure further comprises the step of retracting the drilling arrangement from the ground hole.

In an embodiment of the first aspect, the step of stabilising the inner walls of the hole includes detecting fallback in the hole, and where the amount of fallback exceeds a pre-determined value, instructing the drilling arrangement to repeat any one or more drilling procedures.

In an embodiment of the first aspect, the step of instructing the drilling arrangement to drill in a manner which produces a collar around the hole with debris from the hole comprises instructions to repeatedly penetrate and retract the drilling arrangement within the hole.

In an embodiment of the first aspect, the step of instructing the drilling arrangement to flush the drill hole comprises instructions to increase the flow of liquids from the drilling arrangement to the drill hole.

In an embodiment of the first aspect, the step of instructing the drilling arrangement to stabilise the inner walls of the hole comprises instructions to repeatedly penetrate and retract the drilling arrangement within the hole.

In an embodiment of the first aspect, statuses relating to the drilling arrangement are monitored by a processor.

In an embodiment of the first aspect, the statuses relating to the drilling arrangement includes drill rotation speed, rotation pressure, bit air pressure, pull down speed, pull down pressure, depth sensor, air pressure, fluid flow rate or any combination thereof.

In an embodiment of the first aspect, statuses relating to the drill rig are monitored by a processor.

In an embodiment of the first aspect, the statuses include the position of the drill rig and the initialisation status.

In an embodiment of the first aspect, the statuses are retrieved by at least one sensor, the sensor being in communication with the processor.

In an embodiment of the first aspect, the processor selects steps to instruct the drilling arrangement based on the statuses relating to at least one of the drilling arrangement and/or at least one of the statuses relating to the drill rig.

In an embodiment of the first aspect, the drilling arrangement to manoeuvre the drilling arrangement relative to the desired location of the ground hole.

In an embodiment of the first aspect, the processor instructs the drilling arrangement to vary the pull down rate of the drilling arrangement.

In an embodiment of the first aspect, the processor instructs the drilling arrangement to vary the pull up rate of the drilling arrangement.

In an embodiment of the first aspect, the processor instructs the drilling arrangement to vary the rotation speed of the drilling arrangement.

In an embodiment of the first aspect, the processor instructs the drilling arrangement to vary the bit air pressure of the drilling arrangement.

In an embodiment of the first aspect, the processor instructs the drilling arrangement to vary the liquid flow rate of the drilling arrangement.

In an embodiment of the first aspect, the processor instructs the drilling arrangement to meet a determined target by controlling the pull up rate, pull down rate, rotation speed, bit air pressure, liquid flow rate or any combination thereof.

In an embodiment of the first aspect, the processor instructs the drilling arrangement to meet a determined target by maneuvering the drilling arrangement.

In an embodiment of the first aspect, the determined target is to drill a hole of a predetermined depth.

In an embodiment of the first aspect, the determined target is to maximise penetration rates whilst minimising wear on the drill arrangement.

In an embodiment of the first aspect, the determined target is to maintain a stable collar.

In accordance with a second aspect of the present invention, there is provided a system for autonomous drilling of ground holes by a drill rig including a drilling arrangement, comprising: locating module arranged to locate the drill rig in a position where the hole is to be drilled; and, a processor arranged to process a drilling procedure to control the drilling arrangement to drill the hole.

In accordance with a third aspect of the present invention, there is provided a computer program comprising at least one instruction for controlling a computer system to implement a method in accordance with the first aspect.

In accordance with a fourth aspect of the present invention, there is provided a computer readable medium providing a computer program in accordance with the first aspect.

In accordance with a fifth aspect of the present invention, there is provided a transmission or receiving a data signal including the program code of the first aspect.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1:
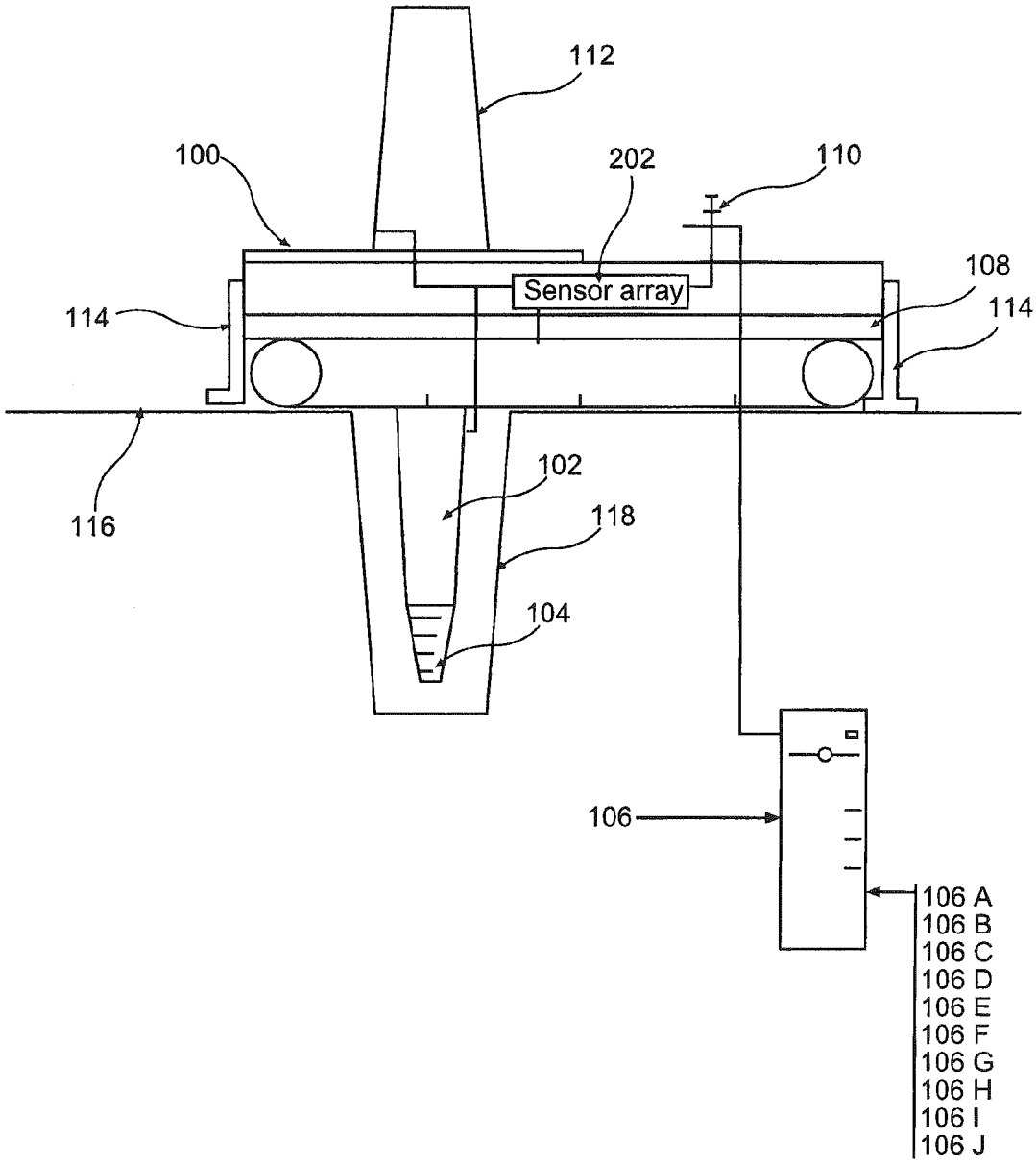
FIG. 1 is a diagram illustrating a drill rig in accordance with one embodiment of the present invention.

Referring to FIG. 1, there is shown an embodiment of a method for the autonomous drilling of ground holes by a drill rig including a drilling arrangement, comprising the step of: utilising an autonomous drilling procedure to control the drilling arrangement to drill the hole on locating the drill rig in a position where the hole is to be drilled.

In this embodiment, the drill rig 100 has a frame 112 housing a number of components such as a drill string 102 connected to a drill bit 104, which define at least part of the drilling arrangement. In operation, the drill rig 100 positions the drill arrangement over a surface 116 for drilling into the surface to produce a hole 118. As the person skilled in the art would appreciate, in the context of the present specification the drilling arrangement can include, without limitation, any components which facilitate the drilling of ground holes, including the frame 112, drill string 102, drill bit 104, air or fluid pumps suitable for delivering fluids to the drill bit 104 or surface, or engine or power source, controlling mechanisms such as hydraulic controls to position the drill string 102 and/or actuator systems which activate and control each of the drilling components.

In this example, the drill rig 100 is a mobile drill rig having tracks 108 to facilitate its movement on a surface and a plurality of hydraulic jacks 114 arranged to level the rig 100 during the drilling operation. The jacks 114 also reduce the stress of the drilling operation on the tracks 108 of the rig, and thereby increase the service life of the tracks 108.

In some embodiments, the drill rig 100 has a drilling arrangement including a rotary type drill whereby the drill is driven in a rotary manner into the ground to produce a hole. In these embodiments, the rotary type drill uses rotary drill bits to cut into the surface. In other embodiments, the drill rig 100 may have a hammer type drilling arrangement suitable for percussion drilling. In these embodiments, a hammer drill bit is fitted into a hammer which is used to force the hammer drill bit into the surface in order to cut or break into the surface. Depending on the terrain and/or application, either type of drilling arrangement may be used as required, and the autonomous drilling methodology described herein may be applied to the described or other drill types.

The drill rig 100 is connected to a control system 106 which in this embodiment comprises a computing module which may be standalone (such as a server) or may be a module within a larger multifunction computing system. The server or computing module 106 may be located within the drill rig 100, or connected to the rig 100 through a telecommunication connection 110. In this embodiment, the computing module 106 comprises suitable components necessary to receive, store and execute appropriate computer instructions. The components may include a processing unit 106A, read-only memory (ROM) 106B, random access memory (RAM) 106C, and input/output devices such as disk drives 106D, input devices 106E such as an Ethernet port, a USB port, etc., display 106F such as a liquid crystal display, a light emitting display or any other suitable display, and communications links 106G. The computing module 106 includes instructions that may be contained in ROM 106B, RAM 106C or disk drives 106D and may be executed by the processing unit 106H. There may be provided a plurality of communication links 106I which may variously connect to one or more computing devices such as a server, personal computers, terminals, wireless or handheld computing devices, and/or proprietary control interfaces. At least one of a plurality of communications links may be connected to an external computing network through a telephone line or other type of communications link.

The computing module 106 may include storage devices such as a disk drive 106D which may encompass solid state drives, hard disk drives, optical drives or magnetic tape drives. The computing module 106 may use a single disk drive or multiple disk drives. The computing module 106 may also have a suitable operating system 106J which resides on the disk drive or in the ROM of the server or computing module 106.

In this embodiment, the computing module 106 is arranged to receive data from the drill rig 100 relating to its position and operational status, process received data utilising the processor (and other hardware, such as memory) and provide controlling signals to the drill rig 100 to control the operation of the drill rig 100. The controlling signals include, but are not limited to, the movement of the drill rig 100 from a first location to a second location, or the execution of a drilling procedure of which an example is described below with reference to FIGS. 3, 4 and 5. The computing module 106 may also execute individual procedures which may be stored in executable modules such as software functions, programmable arrays, ROM, programmed hardware modules, etc. to provide drilling methodologies for processing by a processor 200 of the computing module 106.

Figure 2:
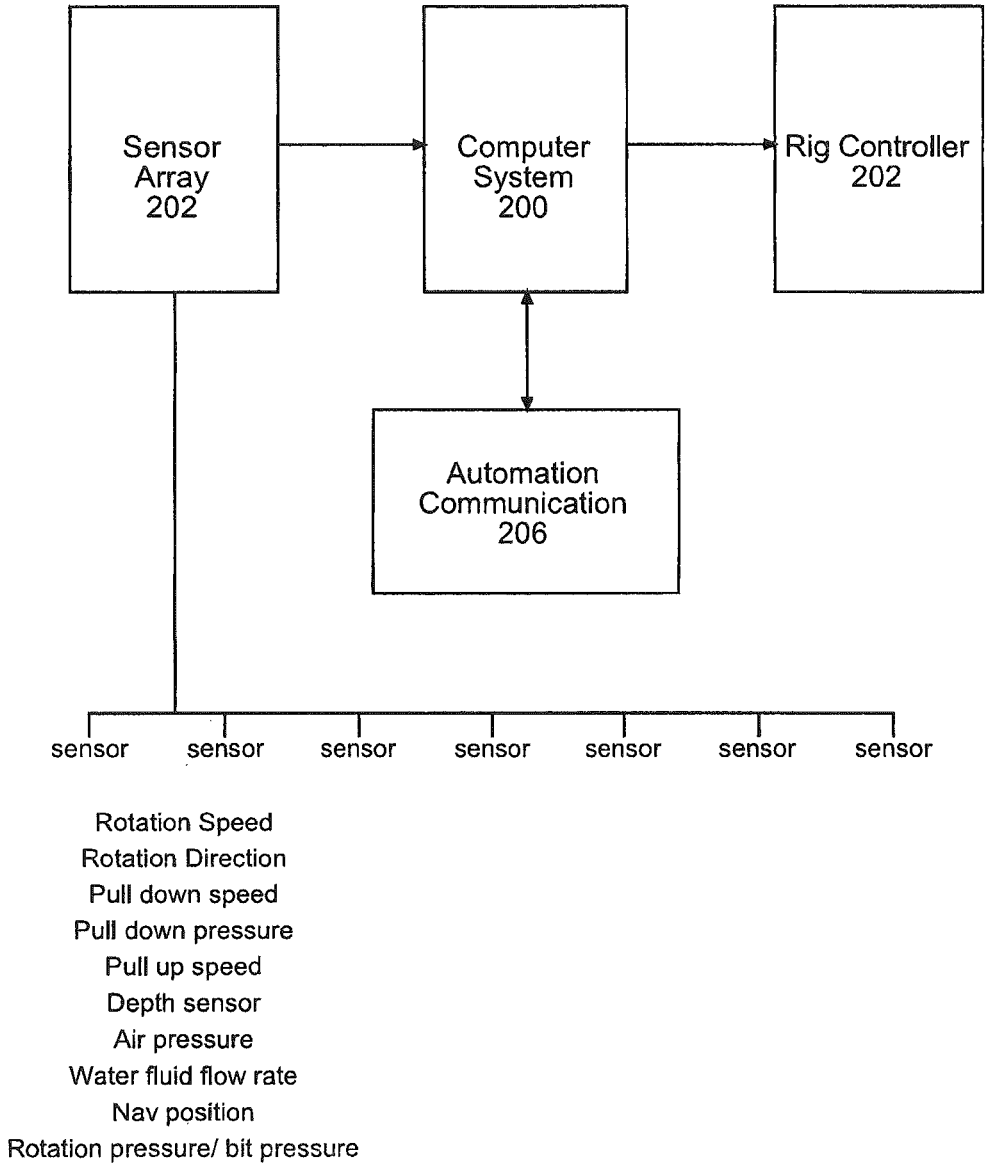
FIG. 2 is a schematic diagram of the sensors, processor and controller of the drill rig of FIG. 1.

With reference to FIG. 2, there is shown an embodiment of the processor 200 within the computing module 106 connected to a sensor array 202 and a drill rig controller 204.

In this embodiment, the processor 200 is arranged to monitor the operation of the drill rig 100 by receiving, recording and processing the data received from each of the sensors of the sensor array 202. Once the sensor data is received, the processor 200 executes a suitable program to process and consider the data received from the sensor and provides a list of instructions to the drill rig controller 204 which interfaces with the drill rig 100 in order to operate the drill rig 100.

As illustrated, the sensor array 202 comprises multiple sensors which are located throughout the drill rig. These sensors include, but are not limited to:

A) Sensors relating to the operation and status of the Drill String/Bit:

1—Drill rotation speed;
2—Drill rotation direction;
3—Rotation Pressure;
4—Bit air pressure;
5—Pull-Down Speed;
6—Pull-Down Pressure;
7—Depth Sensor;
8—Air Pressure; and
9—Water/Fluid flow rate;

B) Sensors relating to the Drill Rig Status:

1—Position; and
2—Initialisation/readiness status.

These sensors are positioned throughout the drill rig and provide data relating to the operation of the drill for processing by the processor. In the embodiment described herein, the sensors are connected to a bus or other connective network (not shown) to form a sensor array 202 capable of transmitting the information to the processor 200 for processing.

Once the processor 200 receives information from the sensor array 202, the processor 200 is arranged to monitor the information and process the information to find a suitable and optimal method to either initiate, continue or complete the drilling operation. Once the method is determined by the processor 200, the method is translated into machine instructions by the drill rig controller 204 which then connects to the drill rig 100 to operate the tracks 108, drill string 102, drill bit 104 and/or jacks 114 to initiate, continue or complete a drilling procedure. During the drilling procedure, feedback information from the sensor array 202 is provided to the processor 200 and based on information received. The processor 200 adjusts the operation of the drill rig 100 by determining the suitable or optical method of drilling, which is transmitted to the controller 204 to be executed by the drill rig 100. This process of feedback and adjustment continues through a loop until the drilling operation is complete.

The processor 200 may be connected to an automation communication module 206 arranged to transmit data to a separate location such that the operation of the drill rig 100 and the information monitored and processed by the processor 200 may be observed by a remote user or stored for record purposes. In some embodiments, the automation communication module 206 has an interface to allow a user to manually override the processor 200 and issue commands to control the drill rig 100 manually.

Figure 3:
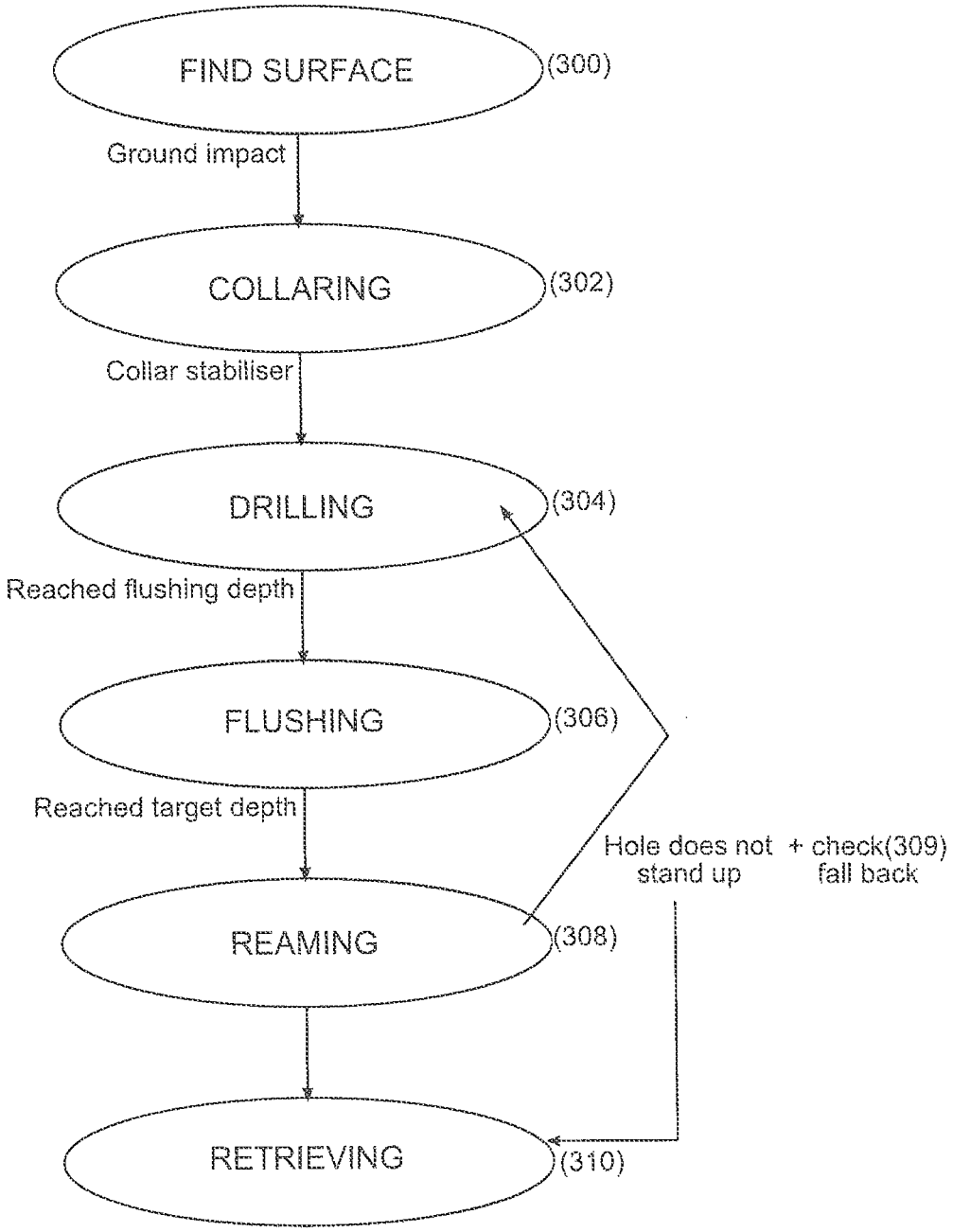
FIG. 3 is a flow diagram illustrating an example operation of a drill rig in accordance with FIG. 1.
Figure 4A:
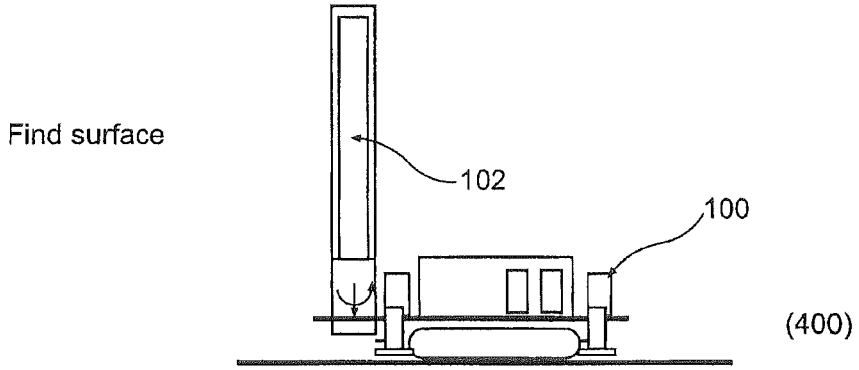
FIGS. 4 *a-f* are diagrams illustrating the operation of the drill bit in accordance with each step illustrated in FIG. 3; and, FIG. 5 is a chart illustrating the operating depth of the drill in an example drilling procedure.
Figure 4B:
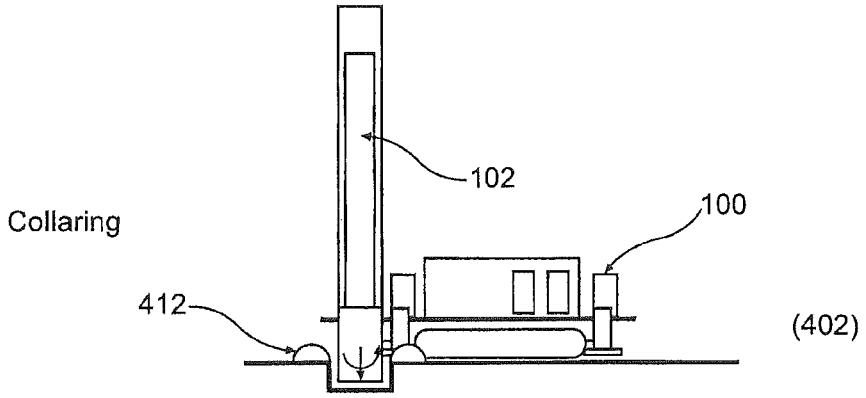
Figure 4C:
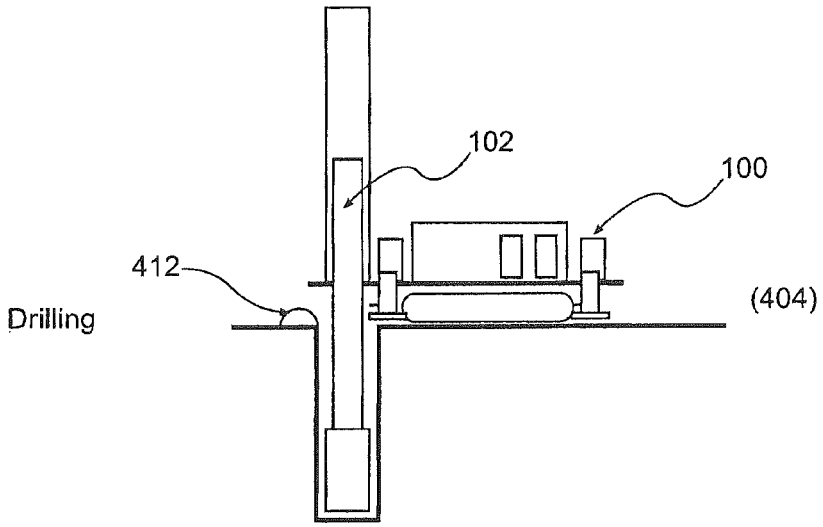
Figure 4D:
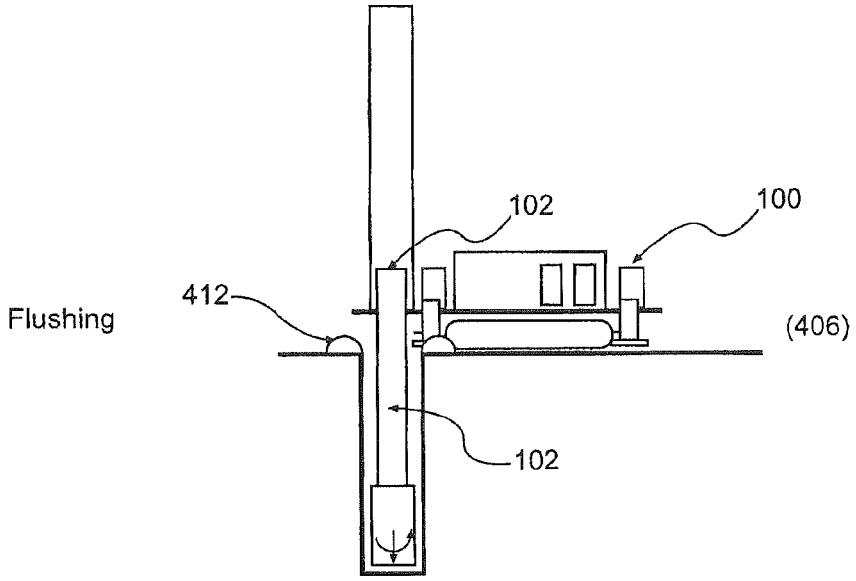
Figure 4E:
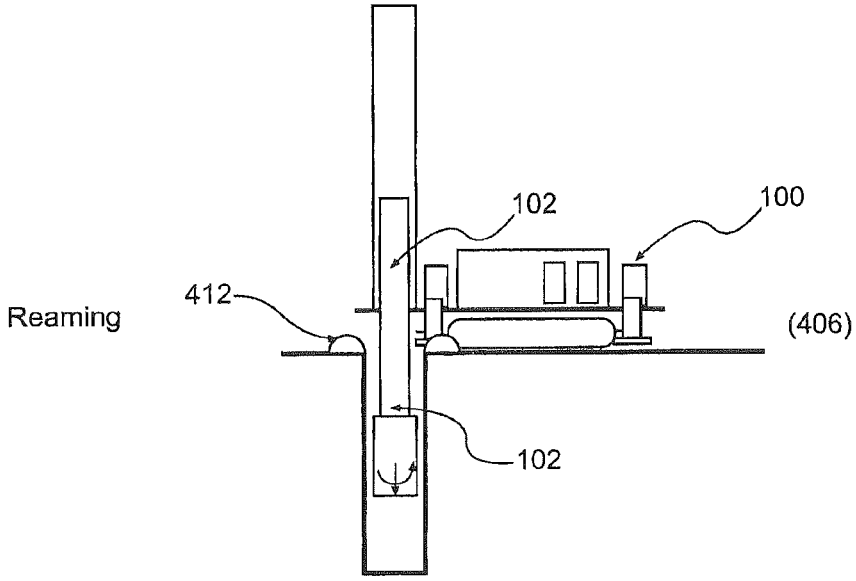
Figure 4F:
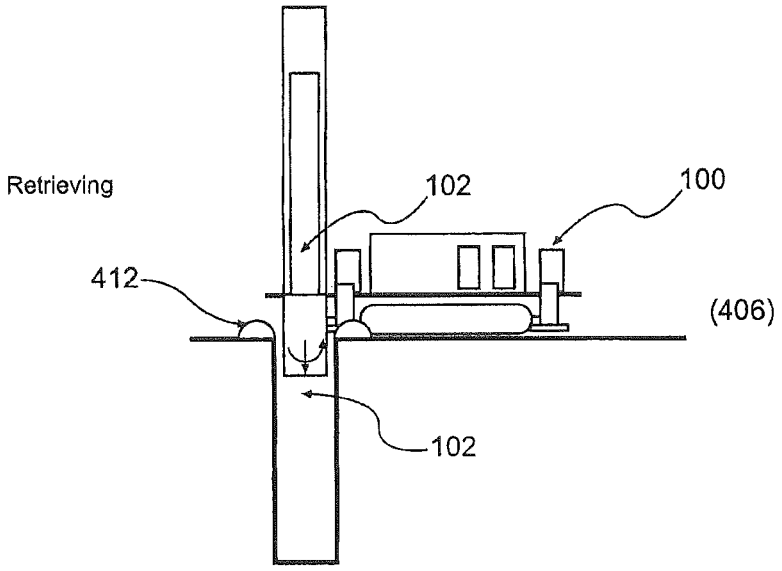

With reference to FIGS. 3 and 4, an example of a drilling procedure is shown. In this example, each procedure (300) to (310) (also shown in FIG. 4) is processed by the processor 200 whilst monitoring the information received from the sensor array 202. Once each step is completed, the processor 200 proceeds to the next step. It will be appreciated by the person skilled in the art that not all steps outlined below may be necessary for each hole drilled, as environmental factors or ground conditions may render some of the steps redundant or superfluous. In cases where conditions preclude the need to carry out certain steps, the processor 200 may automatically skip or override the step, or a user may manually override the step either before or during the drilling operation.

In the example drilling methodology described herein, the drill rig 100 is firstly initialised to be in a ready state before the drilling operation is started. This may include detection of whether the drill rig has been physically prepared for drilling (such as the shutting of trap doors, etc). As the person skilled in the art will appreciate, different drill rigs have individual types of initializing checks. The status of the drill rig 100 is transmitted from the sensor array 202 to the processor 200 for processing. Once the processor 200 checks off the sensor information and deems the rig 100 ready for drilling, the processor will proceed to execute the find surface module (300) to detect the surface level of a drill site (300).

The find surface module (300) is responsible for the detection of the surface level. This process is arranged to ascertain:

the location of the hole to start the collaring process;
the level of the entrance of the hole;
the depth of the hole relative to the surface which is to be drilled; and
the absolute depth of the hole in 3D space (as determined by a navigation solution, such as GPS), of the drill rig.

In this example, the module (300) instructs the drill string 102 to move slowly towards the surface whilst the drill bit 104 is rotated (400). The processor 200, through the sensor array 204, monitors the pressure on the drill rig 100 whilst the drill bit 104 contacts the surface. Generally, the faster the drill string is lowered into the surface, the higher the pressure on the drill string 102 and drill bit 104.

In this embodiment, the surface level detection step may be effected by any one of several possible methodologies. In one example, the processor 200 monitors for pressure spikes based on the pull down operation of the drill string 102 whilst monitoring the rotation or bit air pressure of the drill. Once the pull down rate approaches zero, the surface level is likely to have been detected. However, to ensure accuracies in surface level detection, two additional measures can be considered by the processor 200.

The first of these measures includes the use of an offset in ground detection wherein the offset is configured based on the geometry of the drill. The offset allows the processor 200 to consider the detection of the surface level by comparing the offset with the information received from the sensor regarding the pull-down rate. By using this offset, the geometry of the drill rig is included in determining the surface level and thereby increases the accuracy of the ground detection step.

The second measure includes the evaluation of the pressure spikes and reduction in pull down speed over a short period of time. By monitoring these values over a short period of time, the processor 200 can determine that the pull down speed and higher pressure levels are sustainable and not temporary, which therefore indicates that a surface level has been detected.

Once the processor 200 detects the surface, the level is stored as the current surface level in either volatile memory or in permanent memory such as a disk or database controlled by the processor 200. This value can then be used to determine whether a suitable hole depth has been attained at a later stage.

In alternative embodiments, navigation solutions such as, but not limited to the GPS (Global Positioning System) service can be used to find the suitable depth of the hole that is to be drilled. As navigation solutions, including the GPS service, are able to provide a co-ordinate in 3D space (relative to a suitable datum), the absolute depth of a hole once drilled can also be detected based on the received 3D co-ordinates. By comparing this to the surface level which has been detected by the processor 200, the processor can find the relative depth of the hole by comparing the absolute depth of the hole with the surface level.

The processor 200 then proceeds to begin the collaring process by executing the instructions of the collaring module (302).

The collaring module (302) is arranged to operate the processor 200 to control the drill rig to execute a collaring procedure (402). A collaring procedure is a drill procedure whereby debris from a drill hole is brought to the surface to form a "collar" around the entrance to the hole, in order to stabilise the entrance of the hole. As such, the collaring procedure forms a collar 412 of debris from the drill hole. This measure is important in situations where the ground is very soft or if the ground is shattered or composed of gravel or other loose material. By producing a collar 412 around the hole before the drilling is initiated, the amount of "fall back" which falls into the hole during the drilling process is reduced.

In this embodiment, the processor 200 monitors the information from the sensor array 204 to determine whether the collaring procedure is required. If, for example, the ground to be drilled is very hard, the processor may choose to skip the collaring procedure. However, where the processor 200 determines that the collaring process is to proceed, the processor 200 executes the instructions of the collaring module (302).

In this example, the collaring module (302) instructs the drill rig 100 to drill with lower set-points but with full air and high water or fluid settings. These settings are configurable and depend on the geology of the site. Once the drilling process is initiated and after a certain configurable distance, or, if hole fall in has been detected by monitoring increasing air pressure and decreasing drilling performance, the drill movement is reversed and the drill string 102 will be pulled out of the hole or moved up a configurable distance from the hole. This process will transport parts of the material or debris which have fallen in the hole during the drill process out onto the surface to form part of the collar 412. Debris which falls back into the hole during this process can be removed by further drilling of the hole by the drill bit 104, which will shatter the fallback within the hole.

Once the procedure listed above is complete, the drill is lowered into the hole again and the drilling repeated until a configurable distance has been reached or the amount of fallback in the hole is acceptable. Preferably, at least one pullout cycle is required as the water or fluid delivered to the drill is spread up and down the hole to form a layer of clay on the inner walls of the hole to stabilise the structure.

Once the collaring procedure is complete, the drilling module (304) is executed by the processor 200 to start the drilling procedure (404). The module (304) is arranged to maximise penetration rates whilst reducing unnecessary wear and tear on the drilling rig 100. In order to facilitate this requirement, the processor 200 monitors the depth of the hole, pull down pressure and the rotation pressure (bit air pressure in percussion drilling). The drilling module (304) monitors these values and assesses the values to ascertain the progress of the drilling (depth) and pressure on the drill rig 100 (rotation pressure or pull down pressure).

As the geology of the ground may change as the drill pushes further into the ground, the processor 200 continues to monitor these variables which are detected by the sensors and transmitted to the processor 200 by the sensor array 204. The processor 200, by executing the drilling module, balances the progress of the drilling operation (depth or penetration rates) with the pull down or rotation pressure of the drill. If, for example, the rotation pressure or pull down pressure exceeds a certain threshold whilst the level of penetration is minimal, the pull down or pull up speed may be adjusted in response to these detected values. Preferably, the processor 200 finds an optimal target that maximises drill penetration whilst minimising wear and tear on the drill or, ensuring the collar is stable during the drilling process. The drilling process is deemed to be complete when a certain flushing depth has been reached.

In alternative embodiments, the drilling module (304) may also control the inflow of air and/or water/fluid into the hole to assist with the drilling process. The addition of water, fluids or air into the hole during the drilling process may be invoked to reach the optimal target of maximising drill penetration.

Once the drilling procedure (404) is completed, the flushing module is executed by the processor 200 (304). The flushing module instructs the rig to complete a flushing procedure (406), which is usually executed when the drill has almost reached a desired depth (say, within the last few meters of the desired depth of the hole). The flushing module operates in a similar manner to the drilling module but increases the amount of water or fluid flow rate to the hole. This increase in water or fluid flow rate may increase the moisture or wetness in the collar 412, which may cause a layer of crust to form on the collar 412 and thereby assist in further stabilising the collar 412.

Once the flushing is completed, the processor 200 initiates the reaming module (308) which activates the reaming process. The reaming process is the process of clearing out the hole and assuring the stability of the hole. In one example, this is achieved by retrieving the drill string from the bottom of the hole to the top, and repeatedly moving the drill string 102 to the bottom of the hole (408), to test the integrity of the hole. Of course, in some geological conditions, this step may not be necessary.

During the reaming process (408), the processor 200 may monitor the depth of the hole and decide whether the hole is of a suitable depth. As fallback or incomplete drilling may have caused the depth of the hole to have changed, the processor 200 may decide to repeat the drilling or flushing process to ensure the hole is of a suitable depth. This is particularly important in blasting operations where the depth of the hole, including fallback, must be carefully measured to ensure maximum explosive capability is extracted from blasting material which is detonated in the hole. As shown at (309), the reaming process may repeat the steps of drilling, flushing and reaming until a suitable depth is reached.

Once the reaming module (310) has been completed, the processor 200 will execute the retrieving module which will retrieve the drill string 102 and drill bit 104 from the hole to the deck level of the rig 100. The reaming module may include instructions to shut off water or air flows whilst also switching off the drill.

In alternative embodiments, the processor 200 may execute additional instructions to assist in the execution of each of the procedures in FIG. 3. These additional instructions include:

1. Bog detection—where the processor detects that the drill string has been bogged by looking for high rotation pressure but low rotation RPM with little or low penetration rates.

2. Hammer jam detection—where the processor 200 detects that the hammer has been jammed by identifying that there is a high bit air pressure but a lower penetration rate.

3. Hole fall in detection—where the processor 200 detects that material or debris is falling into a hole which may jam the drill string. This can be identified by monitoring rising bit air pressure, lower penetration rates whilst rotation and pull down pressure remains normal.

There is also provided an interface which is connected to the processor 200 to allow an operator to manually override or reprogram each of the modules (302) to (310). In some embodiments, the interface is located remotely from the drill rig 100. In these embodiments, the processor 200 may also be remote from the drilling rig 100 and is connected to the drilling rig 100 through a remote or telecommunications method such as Wi-Fi, Ethernet, Internet, wireless bus technology, optical fibre or Mobile phone technologies.

Figure 5:
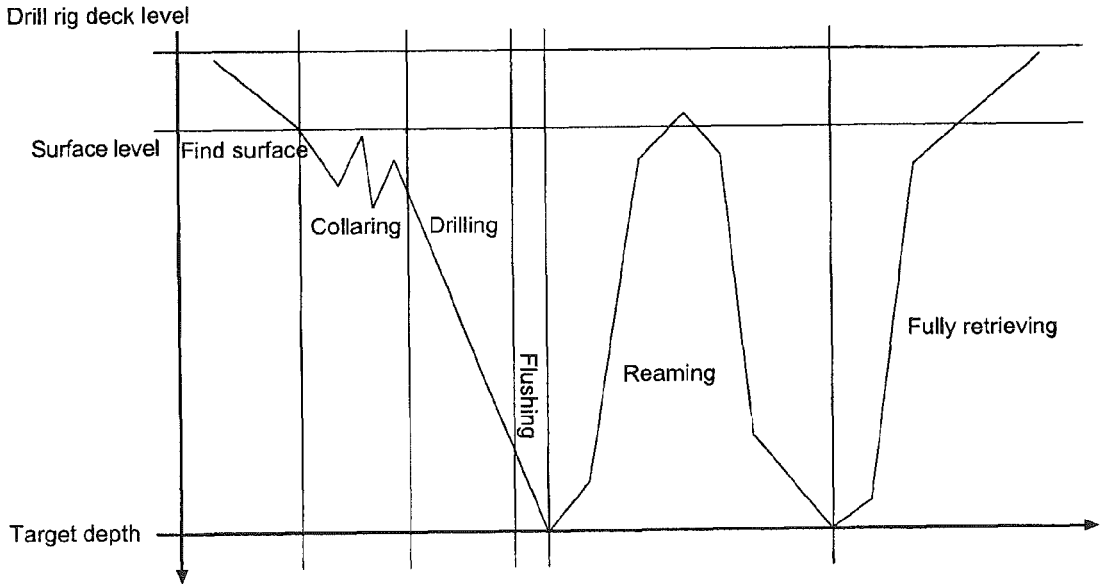

With reference to FIG. 5, there is illustrated the depth of the drill string 102 for an embodiment of each of the processes as outlined in FIG. 3. In this embodiment, the processor 200 and the drill rig controller 204 moves the position of the drill string 102 in and out of the hole based on the procedure (400 to 410) currently executed by the processor 200.

In the stages of detecting a surface, the drill rig 100 is positioned over a surface and uses the drill string to locate the surface (400). As there is a small distance between the deck of the drill rig 100 and the surface, the drill string is slowly lowered as described herein to find the surface and record its location so as to ascertain the depth of the hole once the drilling is complete.

Once the surface is detected, the collaring procedure (402) is executed. In the collaring procedure, the drill string is penetrated into the surface and repeatedly retracted and penetrated into the surface in order to form a stable collar. This repeated penetration and retraction of the drill string assist in the construction of the collar 412 from the debris retrieved from the drilling operation.

The collar 412 is particularly useful in some embodiments of drilling procedures as the collar assists in stabilising the entrance of hole that is being drilled. By forming the collar, debris which may fall back into the hole during the drilling process is minimised since at least part of the debris formed from the drilling is used in the formation of the collar. Also, as the collar may also be packed or wet with fluids, the collar itself may form a layer of crust which assist in the stabilisation of the entrance of the drill hole, and thereby increase the chances of a successful drilling operation.

After the collaring procedure is complete, the drilling procedure is initiated and the drill string is proceeded to penetrate into the ground to form the hole. At this stage, the processor 200 continues to monitor the variables detected from the sensor so as to keep track of how deep the hole is whilst also controlling the drill to reach an optimal target of maximising penetration whilst minimising wear on the drill. Once the drill string approaches the target depth, the flushing procedure is initiated to reach the target depth. At this stage, the flushing procedure is similar in that the drill string continues towards the target depth, but additional water or drilling fluids are pumped into the hole.

Once the target depth has been reached, the reaming procedure is started. This procedure retrieves the drill string from the bottom of the hole to the surface and back to the bottom of the hole. By executing this manoeuvre on the drill string, the hole is stabilised as the inner surfaces of the hole is packed and a layer of clay is formed. This manoeuvre may be repeated through various iterations based on the geology of the site.

Upon the completion of the reaming procedure, the drill string is then retrieved from the hole and returned to the deck level. This thereby completes the drilling process for the hole allowing the drill rig to proceed to the next drilling operation.

An advantage of using an autonomous drilling system or method is that at least in an embodiment, the quality of a drilled hole is generally of a higher quality than manual methods of drilling a hole. In manual methods of drilling, the drilling procedure is often slow and inefficient. As such, operators of drills must focus on the quantity of holes drilled for a particular project or task. In order to operate effectively, operators may reduce the quality of any hole drilled by not ensuring the hole is stabilised during the drilling process (resulting in hole collapse), or by drill holes which are not of an appropriate size or depth. However, at least in an embodiment of the autonomous drilling method, the drilling procedures operate to consider the stability of a hole whilst operating efficiently when compared with manual drilling procedures.

Although not required, the embodiments described with reference to the Figures can be implemented as an application programming interface (API) or as a series of libraries for use by a developer or can be included within another software application, such as a terminal or personal computer operating system or a portable computing device operating system. Generally, as program modules include routines, functions, objects, components and data files, the skilled person will understand that the functionality of the software module application may be distributed across a number of routines, functions, objects components or data files to achieve the same functionality.

It will also be appreciated that where the methods and systems of the present invention are implemented by a computing system or partly implemented by computing systems then any appropriate computing system architecture may be utilised. This includes stand alone computers, networked computers and/or dedicated computing devices which may perform multiple functions, some functions being unrelated to the invention described herein. For example, the drilling rig may include computerized functions such as error handling, movement control or communication systems which are integrated or programmed to operate with drilling methodologies described herein as a complete software package. Where the terms "computer", "computing system" and/or "computing device" are used, these terms are intended to cover any appropriate arrangement of computer hardware for implementing the functionality or software described.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method for the drilling of ground holes by a track steer drill rig including a drilling arrangement that permits the speed of drilling holes to be balanced against the stability of the hole thus formed, the method comprising the steps of:

locating the track steer drill rig in a position where a hole is to be drilled;

monitoring at least one status relating to at least one of the drilling arrangement and the drill rig;

selecting one of a plurality of autonomous procedures for the drilling arrangement to execute based on at least one said status;

controlling the drilling arrangement to drill the hole utilising said one of the autonomous procedures; and allowing a remotely located operator to intervene during the autonomous procedure and override or reprogram the selected autonomous procedure such that the drilling arrangement operates the drill rig according to a different autonomous procedure.

2. The method for the drilling of ground holes in accordance with claim 1, wherein the procedures comprise a collaring procedure for instructing the drilling arrangement to drill in a manner which produces a collar around the hole with debris from the hole.

3. The method for the drilling of ground holes in accordance with claim 2, wherein the collaring procedure comprises instructions to repeatedly penetrate and retract the drilling arrangement within the hole.

4. The method for the drilling of ground holes in accordance with claim 1, wherein the procedures further comprise a flushing procedure for instructing the drilling arrangement to flush the drill hole.

5. The method for the drilling of ground holes in accordance with claim 4, wherein the flushing procedure comprises instructing the drilling arrangement to increase a flow of liquids from the drilling arrangement to the drill hole.

6. The method for the drilling of ground holes in accordance with claim 1, wherein the procedures further comprise a reaming procedure for instructing the drilling arrangement to stabilise the inner walls of the hole.

7. The method for the drilling of ground holes in accordance with claim 6, wherein the step of stabilising the inner walls of the hole includes:

detecting an amount of fallback in the hole, and where the detected amount of fallback exceeds a pre-determined value, instructing the drilling arrangement to repeat all or part of the procedure.

8. The method for the drilling of ground holes in accordance with claim 6, wherein the reaming procedure comprises instructing the drilling arrangement to repeatedly penetrate and retract the drilling arrangement within the hole.

9. The method for the drilling of ground holes in accordance with claim 1, wherein the procedures further comprise a retrieving procedure for retracting the drilling arrangement from the ground hole.

10. A computer readable medium providing a computer program comprising at least one instruction for controlling a computer system to implement the method in claim 1.

11. The method according to claim 1, wherein overriding the selected autonomous procedure comprises automatically proceeding to a different one of the plurality of autonomous procedures.

12. A system for drilling of ground holes comprising:

a track steer drill rig including a drilling arrangement;

at least one sensor for measuring at least one status relating to at least one of the drilling arrangement and the drill rig;

a processor arranged to use the at least one sensor to monitor the at least one status and select, based on the at least one status, one of a plurality of autonomous procedures for processing to control the drilling arrangement to drill a hole upon locating the drill rig in a position where the hole is to be drilled an operating center including a user interface located remotely of the track steer drill rig when the drill rig is in use, wherein the system is arranged to allow an operator at the operating center to interact with the user interface to override or reprogram the selected autonomous procedure such that the processor controls the drilling arrangement to operate the drill rig according to a different autonomous procedure.

13. The system for the drilling of ground holes in accordance with claim 12, further comprising a collaring module arranged to instruct the drilling arrangement to drill in a manner which produces a collar around the hole with debris from the hole.

14. The system for the drilling of ground holes in accordance with claim 13, wherein the collaring module comprises instructions to repeatedly penetrate and retract the drilling arrangement within the hole.

15. The system for the drilling of ground holes in accordance with claim 12, further comprising a flushing module arranged to instruct the drilling arrangement to flush the drill hole.

16. The system for the drilling of ground holes in accordance with claim 15, wherein the flushing module comprises instructions to increase a flow of liquids from the drilling arrangement to the drill hole.

17. The system for the drilling of ground holes in accordance with claim 12, further comprising a reaming module arranged to instruct the drilling arrangement to stabilise the inner walls of the hole.

18. The system for the drilling of ground holes in accordance with claim 17, being configured to detect fallback in the hole, and where the amount of fallback exceeds a pre-determined value, to instruct the drilling arrangement to repeat all or part of the drilling procedure.

19. The system for the drilling of ground holes in accordance with claim 17, wherein the reaming module comprises instructions to repeatedly penetrate and retract the drilling arrangement within the hole.

20. The system for the drilling of ground holes in accordance with claim 12, further comprising a retrieving module arranged to retract the drilling arrangement from the ground hole.

21. The system for the drilling of ground holes in accordance with claim 12, wherein the statuses relating to the drilling arrangement include at least one of drill rotation speed, rotation pressure, bit air pressure, pull down speed, pull down pressure, depth sensor, air pressure, and fluid flow rate.

22. The system for the drilling of ground holes in accordance with claim 12, wherein the processor selects steps to instruct the drilling arrangement based on the at least one status.

23. The system for the drilling of ground holes in accordance with claim 12, wherein the processor instructs the drilling arrangement to maneuver the drilling arrangement relative to the desired position where the hole is to be drilled.

24. The system for the drilling of ground holes in accordance with claim 12, wherein the processor instructs the drilling arrangement to vary at least one of a pull down rate, a pull up rate, a rotation speed, a bit air pressure or a liquid flow rate of the drilling arrangement.

25. The system for the drilling of ground holes in accordance with claim 12, wherein the processor instructs the drilling arrangement to meet a determined target by controlling at least one of a pull up rate, pull down rate, rotation speed, bit air pressure, and liquid flow rate.

26. The system for the drilling of ground holes in accordance with claim 25, wherein the determined target is to drill a hole of a predetermined depth.

27. The system for the drilling of ground holes in accordance with claim 26, wherein the determined target is to maximise penetration rates whilst minimising wear on the drill arrangement.

28. The system for the drilling of ground holes in accordance with claim 25, wherein the determined target is to maintain a stable collar.

29. The system for the drilling of ground holes in accordance with claim 12, wherein the processor instructs the drilling arrangement to meet a determined target by maneuvering the drilling arrangement.

30. A method for the drilling of ground holes by a track steer drill rig including a drilling arrangement that permits the speed of drilling holes to be balanced against the stability of the hole thus formed, the method comprising the steps of:

locating the track steer drill rig in a position where a hole is to be drilled;

monitoring at least one status relating to at least one of the drilling arrangement and the drill rig;

commencing execution of a sequence of autonomous procedures for the drilling arrangement based on at least one said status;

manually overriding at least one of the autonomous procedures in the sequence from a location remote of the drill rig; and allowing the drilling arrangement to continue to the next autonomous procedure in sequence.

31. The method for the drilling of ground holes in accordance with claim 30, wherein the at least one of the autonomous procedures in the sequence is manually overridden during execution of said autonomous procedure.

32. The method for the drilling of ground holes in accordance with claim 30, wherein the at least one of the autonomous procedures in the sequence is manually overridden before execution of said autonomous procedure.

33. The method for the drilling of ground holes in accordance with claim 30, wherein at least one of the autonomous procedures in the sequence comprises a collaring procedure for instructing the drilling arrangement to drill in a manner which produces a collar around the hole with debris from the hole.

34. The method for the drilling of ground holes in accordance with claim 30, wherein at least one of the autonomous procedures in the sequence comprises a flushing procedure for instructing the drilling arrangement to flush the drill hole.

35. The method for the drilling of ground holes in accordance with claim 30, wherein at least one of the autonomous procedures in the sequence comprises a reaming procedure for instructing the drilling arrangement to stabilize the inner walls of the hole.

36. The method for the drilling of ground holes in accordance with claim 30, wherein at least one of the autonomous procedures in the sequence comprises a retrieving procedure for retracting the drilling arrangement from the ground hole.

* * * * *